US007708518B2

(12) United States Patent
Chehab

(10) Patent No.: US 7,708,518 B2
(45) Date of Patent: May 4, 2010

(54) TURBINE BLADE TIP CLEARANCE CONTROL

(75) Inventor: Abdullatif M. Chehab, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1282 days.

(21) Appl. No.: 11/165,522

(22) Filed: Jun. 23, 2005

(65) Prior Publication Data

US 2007/0003410 A1 Jan. 4, 2007

(51) Int. Cl.
*F01D 11/16* (2006.01)
*F01D 11/24* (2006.01)

(52) U.S. Cl. ..... 415/115; 415/1; 415/116; 415/173.1; 415/173.2; 415/176; 415/177; 60/782; 60/785; 60/806

(58) Field of Classification Search ..... 415/1, 415/115–117, 173.1, 173.2, 173.3, 175–178; 60/782, 785, 806
See application file for complete search history.

(56) References Cited

U.S. PATENT DOCUMENTS

| | | | | |
|---|---|---|---|---|
| 2,584,899 | A * | 2/1952 | McLeod | 415/115 |
| 3,975,901 | A | 8/1976 | Hallinger et al. | |
| 4,019,320 | A | 4/1977 | Redinger, Jr. et al. | |
| 4,069,662 | A | 1/1978 | Redinger, Jr. et al. | |
| 4,247,247 | A | 1/1981 | Thebert | |
| 4,268,221 | A | 5/1981 | Monsarrat et al. | |
| 4,329,114 | A | 5/1982 | Johnston et al. | |
| 4,338,061 | A | 7/1982 | Beitler et al. | |
| 4,363,599 | A | 12/1982 | Cline et al. | |
| 4,541,775 | A | 9/1985 | Hovan | |
| 4,576,547 | A | 3/1986 | Weiner et al. | |
| 4,648,241 | A | 3/1987 | Putman et al. | |
| 4,856,272 | A | 8/1989 | Putman et al. | |
| 4,893,983 | A | 1/1990 | McGreehan | |
| 4,893,984 | A | 1/1990 | Davison et al. | |
| 4,928,240 | A | 5/1990 | Davison et al. | |
| 5,035,573 | A | 7/1991 | Tseng et al. | |
| 5,048,288 | A * | 9/1991 | Bessette et al. | 60/806 |
| 5,076,050 | A | 12/1991 | Schwarz et al. | |
| 5,116,199 | A | 5/1992 | Ciokajlo | |
| 5,127,793 | A | 7/1992 | Walker et al. | |
| 5,127,794 | A | 7/1992 | Burge et al. | |
| 5,147,178 | A | 9/1992 | Treece | |

(Continued)

FOREIGN PATENT DOCUMENTS

| | | |
|---|---|---|
| CA | 2232781 | 10/2001 |

(Continued)

*Primary Examiner*—Christopher Verdier

(57) ABSTRACT

A system and method for actively managing blade tip clearances in a turbine engine, particularly under steady state operating conditions such as at base load, involves routing a portion of air from a rotor cooling air circuit to a vane carrier or other stationary support structure surrounding the turbine blades. Because the temperature of the air is less than the temperature of the stationary support structure, the stationary support structure will thermally contract when the air is passed in heat exchanging relation therewith. In one embodiment, the air can be passed through one or more passages extending through at least a portion of the stationary support structure. The contraction of the stationary support structure reduces the blade tip clearance because the blades do not contract. Thus, fluid leakage through the clearances is minimized, which in turn can increase engine performance.

10 Claims, 2 Drawing Sheets

U.S. PATENT DOCUMENTS

| | | | | | |
|---|---|---|---|---|---|
| 5,169,287 | A | | 12/1992 | Proctor et al. | |
| 5,212,940 | A | | 5/1993 | Glover | |
| 5,219,268 | A | | 6/1993 | Johnson | |
| 5,351,478 | A | | 10/1994 | Walker et al. | |
| 5,351,732 | A | * | 10/1994 | Mills et al. | 415/175 |
| 5,394,687 | A | * | 3/1995 | Chen et al. | 60/806 |
| 5,605,437 | A | | 2/1997 | Meylan | |
| 5,779,436 | A | * | 7/1998 | Glezer et al. | 415/115 |
| 5,779,442 | A | | 7/1998 | Sexton et al. | |
| 5,868,553 | A | | 2/1999 | Battig et al. | |
| 5,927,946 | A | | 7/1999 | Lee | |
| 6,065,282 | A | * | 5/2000 | Fukue et al. | 415/115 |
| 6,082,963 | A | | 7/2000 | Sexton et al. | |
| 6,120,249 | A | | 9/2000 | Hultgren et al. | |
| 6,126,390 | A | | 10/2000 | Bock | |
| 6,152,685 | A | | 11/2000 | Hagi | |
| 6,354,795 | B1 | | 3/2002 | White et al. | |
| 6,401,460 | B1 | | 6/2002 | Xia | |
| 6,435,823 | B1 | | 8/2002 | Schroder | |
| 6,454,529 | B1 | | 9/2002 | Zearbaugh et al. | |
| 6,487,863 | B1 | | 12/2002 | Chen et al. | |
| 6,502,304 | B2 | | 1/2003 | Rigney et al. | |
| 6,607,350 | B2 | | 8/2003 | Dodd | |
| 6,626,635 | B1 | | 9/2003 | Prowse et al. | |

FOREIGN PATENT DOCUMENTS

| | | | |
|---|---|---|---|
| EP | 0806548 | A1 | 11/1997 |
| EP | 1132577 | A2 | 9/2001 |
| JP | 62111104 | A | 5/1987 |
| JP | 62225703 | A | 10/1987 |
| JP | 03015605 | A | 1/1991 |
| JP | 08193503 | A | 7/1996 |
| JP | 10077804 | A | 3/1998 |
| JP | 2000220407 | A | 9/2001 |
| JP | 2001248406 | A | 9/2001 |
| WO | WO 01/57420 | A1 | 8/2001 |

* cited by examiner

TURBINE BLADE TIP CLEARANCE CONTROL

FIELD OF THE INVENTION

The invention relates in general to turbine engines and, more particularly, to blade tip clearances in the turbine section of a turbine engine.

BACKGROUND OF THE INVENTION

FIG. 1 shows a cross-section through a portion of a turbine engine. A turbine engine 10 can generally include a compressor section 12, a combustor section 14 and a turbine section 16. A centrally disposed rotor 18 can extend through the three sections.

Generally, the combustor section 14 is enclosed within a casing 20 that can form a chamber 22, together with the aft end of the compressor casing 24 and a housing 26 that surrounds a portion of the rotor 18. A plurality of combustors 28 and ducts 30 can be provided within the chamber 22, such as in an annular array about the rotor 18. Each duct 30 can connect one of the combustors 28 to the turbine section 16.

The turbine section 16 can include an outer casing 32 which encloses alternating rows of stationary airfoils 34 (commonly referred to as vanes) and rotating airfoils 36 (commonly referred to as blades). Each row of blades can include a plurality of airfoils 36 attached to a disc 38 provided on the rotor 18. The rotor 18 can include a plurality of axially-spaced discs 38. The blades 36 can extend radially outward from the discs 38 and terminate in a region known as the blade tip 40.

Each row of vanes can be formed by attaching a plurality of airfoils 34 to the stationary support structure in the turbine section 16. For instance, the airfoils 34 can be hosted by a vane carrier 42 that is attached to the outer casing 32. The vanes 34 can extend radially inward from the vane carrier 42 or other stationary support structure to which they are attached.

In operation, the compressor section 12 can induct ambient air and can compress it. The compressed air 44 from the compressor section 12 can enter the chamber 22 and can then be distributed to each of the combustors 28. In the combustors 28, the compressed air can be mixed with the fuel introduced through a fuel nozzle 46. The air-fuel mixture can be burned, thereby forming a hot working gas 48. The hot gas 48 can flow through the ducts 30 and then through the rows of stationary airfoils 34 and rotating airfoils 36 in the turbine section 16, where the gas 48 can expand and generate power that can drive the rotor 18. The expanded gas 50 can then be exhausted from the turbine 16.

It should be noted that each row of blades 36 is surrounded by the stationary support structure of the turbine, which can be the outer casing 32, the vane carrier 42 or a ring seal (not shown). The space between the blade tips 40 and the neighboring stationary structure is referred to as the blade tip clearance C. During engine operation, gas leakage can occur through the blade tip clearances C, resulting in measurable engine performance decreases in power and efficiency.

While small blade tip clearances C are desired to minimize gas leakage, it is critical to maintain a clearance C between the rotating turbine components (blades 36, rotor 18, and discs 38) and the stationary turbine components (vanes 34, outer casing 32, vane carriers 42 and ring seals) at all times. Rubbing of any of the rotating and stationary components can lead to substantial component damage, performance degradation, and extended outages.

However, during transient conditions such as during engine startup or part load operation, it can be difficult to ensure that adequate blade tip clearances C are maintained because the rotating parts and the stationary parts thermally expand at different rates. For instance, in a cold start situation, the rate of thermal expansion of the thermal stationary support structure is at least initially less than the rate of thermal expansion of the rotating turbine components due to the relatively larger size and thickness of the stationary support structure. As a result, the blade tip clearances C can actually decrease because the rotating components expand radially outward faster than the stationary support structure, raising concerns of blade tip rubbing.

To avoid blade tip rubbing, large tip clearances are initially provided so that minimum blade tip clearances C are maintained at known pinch points, that is, during operational conditions where the clearances C would otherwise be expected to be the smallest (hot restart, spin cool, etc.). However, because the minimum blade tip clearances C are sized for these pinch point conditions, the clearances C eventually become overly large as the rate of thermal expansion of the rotating components slows or substantially stops while the stationary support structure continues to grow radially outward. Such oversized clearances C can occur as the engine approaches or attains steady state operation, such as at base load. Consequently, engine power and efficiency can be reduced.

Thus, there is a need for a system that can improve engine performance by minimizing turbine tip clearances at desired engine operating conditions.

SUMMARY OF THE INVENTION

In one respect, aspects of the invention are directed to a method for controlling blade tip clearances in a turbine engine. The turbine engine has a compressor section, a combustor section, and a turbine section. The combustor section receives compressed air from the compressor section. The turbine section includes a rotor with a plurality of discs thereon. A plurality of blades are attached to each disc. Each blade extends radially outward from the disc to a blade tip. The blade tips are substantially proximate a stationary support structure surrounding the blades. The stationary support structure can be a vane carrier, a ring seal and/or an outer casing. The stationary support structure is at a first temperature. A blade tip clearance is defined between the blade tips and the stationary support structure.

According to the method, a portion of the compressed air from the combustor section is extracted. Next, the extracted portion of air is cooled to a second temperature that is less than the first temperature. At least a portion of the cooled air at the second temperature is then passed in heat exchanging relation with the stationary support structure such that the stationary support structure thermally contracts. Such contraction can cause the blade tip clearance to decrease. The passing step can be selectively performed upon the occurrence of an operational parameter. The method can also involve measuring the blade tip clearance and selectively performing the passing step to ensure a target blade tip clearance is maintained.

In one embodiment, at least the passing step can be performed during substantially steady state engine operation. In one embodiment, at least the passing step can be performed during base load operation. In yet another embodiment, at least the passing step can be performed during part load operation.

The method can also include the step of routing the air that has passed in heat exchanging relation with the stationary support structure back to the air at the second temperature so as to form an air mixture at a mixture temperature. The mixture temperature can be measured and, when the measured mixture temperature exceeds a predetermined temperature, the cooling step can be adjusted such that the extracted portion of air is cooled to a temperature less than the second temperature.

In another respect, aspects of the invention related to a blade tip clearance control system. The system includes a turbine engine having a compressor section, a combustor section having a chamber receiving compressed air from the compressor section, and a turbine section. The turbine section includes a plurality of discs mounted to a rotor. A plurality of blades are attached to the discs; each blade extends radially outward from the disc to a tip. The system also includes stationary support structure substantially surrounding at least a portion of the blades. A clearance is defined between the tips of the blades and the stationary support structure. The stationary support structure is at a first temperature. The stationary support structure can be one or more of the following: a vane carrier, a ring seal and an outer casing.

The system further includes a rotor cooling air circuit that includes a fluid conduit and a cooler disposed along the fluid conduit. The fluid conduit is connected in fluid communication with the chamber of the combustor section such that a portion of the compressed air in the chamber is received within the fluid conduit. The portion of compressed air passes in heat exchanging relation with the cooler such that the temperature of the portion of air is reduced to a second temperature that is less than the first temperature.

A supply conduit is connected in fluid communication with the fluid conduit and extends therefrom. The supply conduit routes at least a portion of the air at the second temperature to the stationary support structure so that the air passes in heat exchanging relation with the stationary support structure. As a result, the stationary support structure contracts to reduce the clearance. In one embodiment, one or more passages extend through at least a portion of the stationary support structure. The passage has an inlet and an outlet. The supply conduit is connected in fluid communication with the inlet of the passage such that the passage receives the air at the second temperature.

In one embodiment, the system can also include a return conduit positioned to receive the air that has passed in heat exchanging relation with the stationary support structure. The return conduit can be connected in fluid communication with the fluid conduit, downstream of the area where the supply conduit connects to the fluid conduit. Thus, air that has passed in heat exchanging relation with the stationary support structure can be routed back to the fluid conduit. A temperature measurement device can be operatively associated with the fluid conduit downstream of the area where the return conduit connects to the fluid conduit.

A valve can be operatively positioned along one of the fluid conduit and the supply conduit to selectively permit and prohibit the supply of air at the second temperature to the stationary support structure. In one embodiment, the valve can permit the air at the second temperature to be supplied to the stationary support structure during base load engine operation.

In yet another respect, aspects of the invention concern a blade tip clearance control system. The system includes a turbine engine that has a compressor section, a combustor section having a chamber receiving compressed air from the compressor section, and a turbine section. The turbine section including a plurality of discs mounted to a rotor. A plurality of blades are attached to the discs, and each blade extends radially outward therefrom to a tip.

A stationary support structure substantially surrounds at least a portion of the blades. The stationary support structure can be a vane carrier, a ring seal, an outer casing or any combination thereof. A clearance is defined between the tips of the blades and the stationary support structure. The stationary support structure has one or more passages extending therethrough. The passage has an inlet end and an outlet end. The stationary support structure is at a first temperature.

The system includes a rotor cooling air circuit with a fluid conduit and a cooler disposed along the fluid conduit. The fluid conduit connects between and in fluid communication with the chamber of the combustor section and the inlet end of the passage. A portion of the compressed air in the chamber is received within the fluid conduit and passes in heat exchanging relation with the cooler such that the temperature of the portion of air is reduced to a second temperature, which is less than the first temperature.

A supply conduit connects between and in fluid communication with the second conduit and the inlet end of the passage. The supply conduit routes at least a portion of the air at the second temperature to the passage; the air passes through the passage in heat exchanging relation with the stationary support structure. Thus, the stationary support structure contracts to reduce the clearance. A valve is operatively positioned along one of the fluid conduit and the supply conduit to selectively permit and prohibit the supply of air at the second temperature to the stationary support structure.

In one embodiment, a return conduit can connect between and in fluid communication with the outlet end of the passage and the fluid conduit. The return conduit can connect to the fluid conduit downstream of the area where the supply conduit connects to the fluid conduit. Thus, air exiting the passage is routed back to the rotor cooling air circuit. A temperature measurement device can be operatively associated with the fluid conduit downstream of the area where the return conduit connects to the fluid conduit. The temperature measurement device can be operatively connected to the cooler, allowing the temperature of the coolant exiting the cooler can be altered as necessary.

DETAILED DESCRIPTION OF EMBODIMENTS OF THE INVENTION

Figure 2:
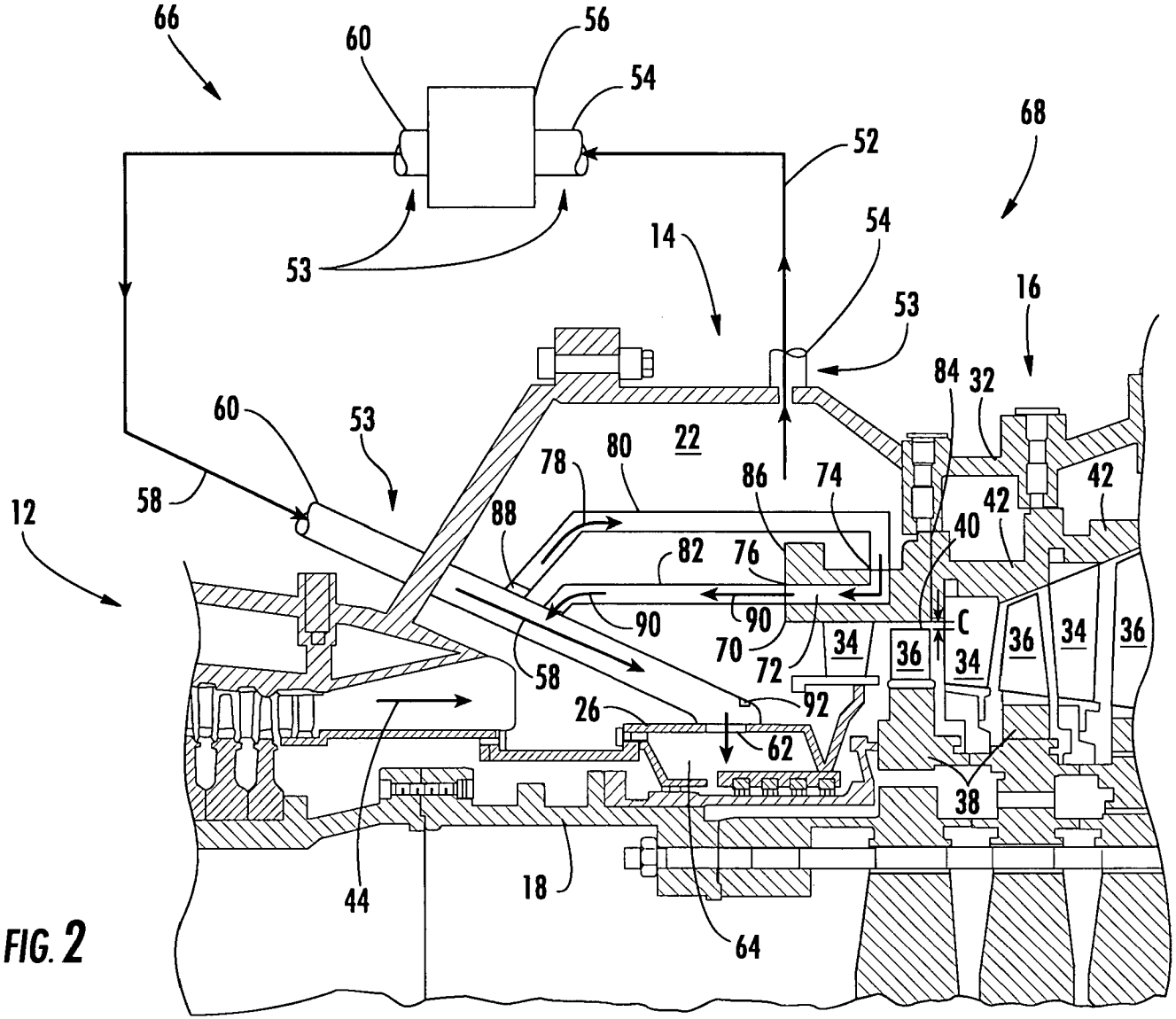
FIG. 2 is a partial cross-sectional view of a blade tip clearance control system according to aspects of the invention, several engine components not shown for purposes of clarity.

Aspects of the present invention relate to a system and method for controlling blade tip clearances in the turbine section of the engine. Embodiments of the invention will be explained in the context of one clearance control system, but the detailed description is intended only as exemplary. Embodiments of the invention are shown in FIG. 2, but aspects of the invention are not limited to the illustrated structure or application.

Generally, the clearance control system according to aspects of the invention involves passing a fluid in heat exchanging relation with the vane carrier 42 or other stationary support structure that is proximate the tips 40 of the rotating airfoils 36. Because air is readily available in a turbine engine, aspects of the invention are particularly suited for using air as the fluid. More specifically, the blade tip clearance control system according to aspects of the invention can make use of the compressed air 44 from the chamber 22 in the combustor section 14.

Figure 1:
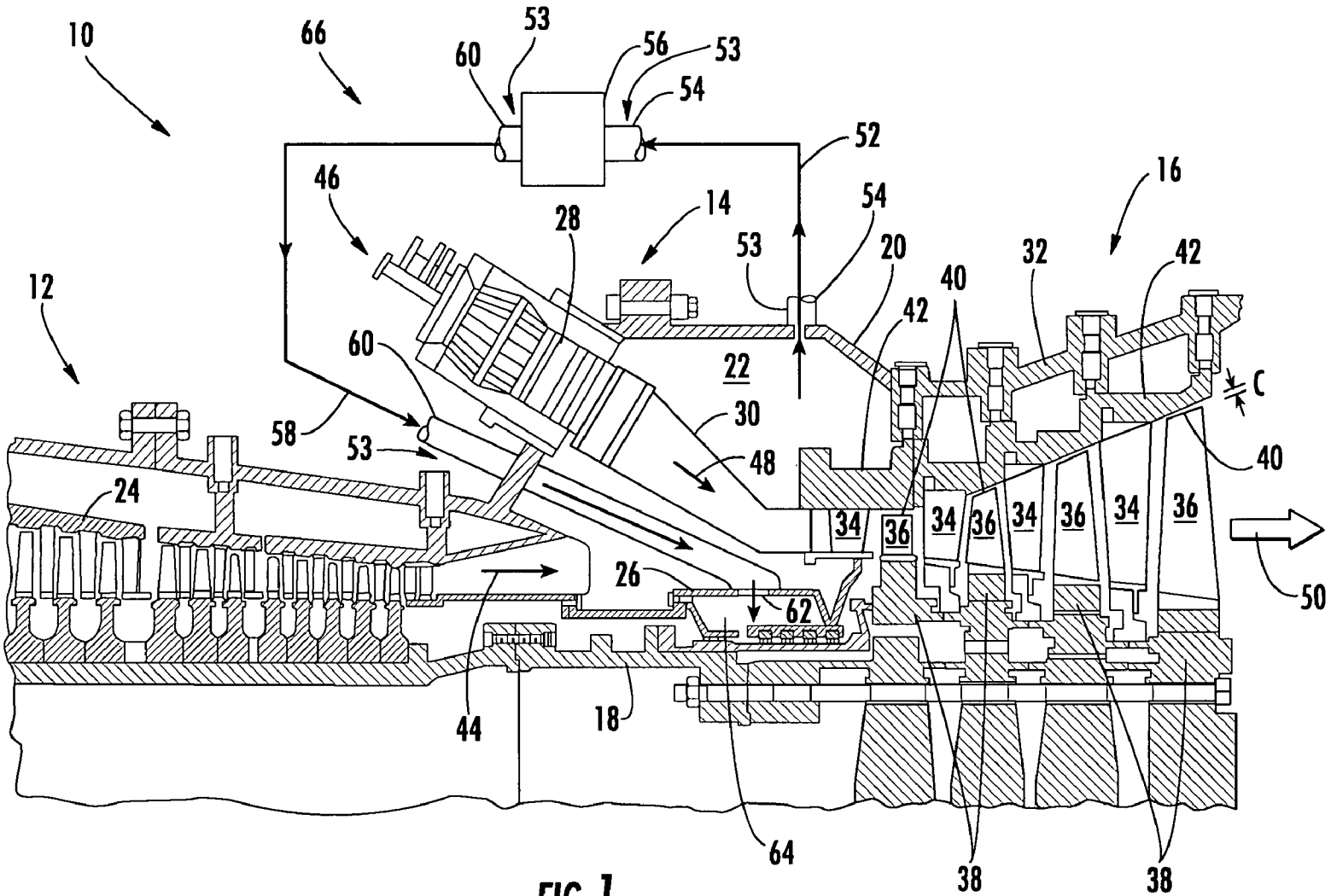
FIG. 1 (PRIOR ART)
FIG. 1 is a cross-sectional view through a portion of a known turbine engine.

As is known, the compressed air 44 from the compressor 12 can be used to cool the rotor 18 or to internally cool the turbine blades 36, among other things. Referring to FIG. 1, a portion 52 of the compressed air 44 from the compressor 12 can be extracted from the chamber 22 and routed externally of the engine 10 through a fluid conduit 53 connected in fluid communication with the chamber 22. The fluid conduit 53 can be a single conduit or a plurality of conduit segments. For convenience, the fluid conduit 53 will be described herein as including a first conduit segment 54 and a second conduit segment 60, but it will be understood that aspects of the invention are not limited to such an arrangement.

By entering the first conduit segment 54, the portion of air 52 bypasses the combustors 28. The portion of air 52 can be cooled by an external cooler 56 disposed along the fluid conduit 53. In one embodiment, the cooler 56 can be a fin-fan heat exchanger. Alternatively, the cooler 56 can be a kettle boiler, which can be used to generate steam in the bottoming cycle in a combined cycle power plant. However, aspects of the invention are not limited to any particular cooler 56, which can be almost any type of heat exchanger. The cooler 56 can be used to reduce the temperature of the portion of air 52. In one embodiment, the temperature of the air 52 extracted from the chamber 22 can be about 800 degrees Fahrenheit. In such case, the cooler 56 can be used to reduce the temperature of the air 52 to about 400 degrees Fahrenheit. These temperatures are provided as examples, and it will be understood that these temperatures can vary from system to system.

After exiting the cooler 56, the cooled air 58 can flow along the fluid conduit 53, such as the second conduit segment 60. The fluid conduit 53 can route the cooled air to one or more openings 62 formed in the housing 26, thereby allowing the air 58 to enter a cooling air manifold 64 that surrounds a portion of the rotor 18. From there, the cooling air 58 can be used to cool various engine components. For convenience, the above-described system of cooling extracted air 52 from the chamber 22 and redirecting it toward the rotor 18 will be generally referred to herein as the rotor cooling air circuit 66.

According to aspects of the invention, blade tip clearances C can be affected by passing at least a portion of the cooled air 58 in the rotor cooling air circuit 66 in heat exchanging relation with the vane carrier 42 or other stationary support structure surrounding one or more rows of blades 36 in the turbine section 16. Greater control of the blade tip clearance C can be achieved by selectively passing the cooled air 58 in heat exchanging relation with the vane carrier 42 or other stationary support structure surrounding one or more rows of blades 36 in the turbine section 16. One example of a blade tip clearance control system according to aspects of the invention is shown in FIG. 2.

While the cooled air can 58 can exchange heat with one or more of the components forming the stationary support structure. The following discussion will concern the vane carrier 70, though it will be understood that aspects of the invention are not limited to the vane carrier 70. It should be noted that the vane carrier 70 can be generally cylindrical in conformation. The vane carrier 70 can be a single piece, or the vane carrier 70 can be a plurality of substantially circumferentially adjacent segments. The term circumferentially is intended to mean circumferential relative to the turbine. In one embodiment, the vane carrier 70 can be made of two generally semi-cylindrical portions. It will be understood that aspects of the invention can be applied to any vane carrier 70 regardless of the configuration and that the term "vane carrier" as used herein refers to any of such configurations.

The vane carrier 70 can be configured to exchange heat with the cooled air 58 from the rotor cooling air circuit 66. In one embodiment, the cooled air 58 can be passed in heat exchanging relation with at least a portion of the exterior of the vane carrier 70. Thus, the exterior of the vane carrier 70 can be configured as needed to facilitate the exchange of heat between the vane carrier 70 and the cooled air 58.

In another embodiment, the cooled air 58 can be passed in heat exchanging relation with at least a portion of the interior of the vane carrier 70. Thus, the vane carrier 70 or other stationary support structure can be configured to receive a portion of air from the rotor cooling air circuit 66. For example, at least one passage 72 can extend through the vane carrier 70 for receiving at least a portion of air 58 from the rotor cooling air circuit 66 and allowing it to flow through the vane carrier 70. The passage 72 can extend between an inlet end 74 and an outlet end 76. Preferably, a substantial portion of the passage 72 can extend generally in the axial direction relative to the turbine. Ideally, the passage 72 spans a substantial portion of the axial length of the vane carrier 70. The passage 72 can be provided in the vane carrier 70 by, for example, machining or casting.

There can be any number of passages 72 in the vane carrier 70, and embodiments of the invention are not limited to any particular number of passages 72. For example, there can be a single passage 72 extending through the vane carrier 70. In another embodiment, there can be two or more passages 72 in the vane carrier 70. In cases where multiple passages 72 are provided, the passages 72 can be substantially equally or unequally circumferentially spaced about the vane carrier 70. Further, the passages 72 can be substantially parallel to each other or at least one of the passages 72 can be non-parallel to the other passages 72. Each passage 72 can be substantially straight or at least one passage 72 can be curved, bent, serpentine or otherwise non-straight.

The passage 72 can have any of a number of cross-sectional shapes. In one embodiment, the passage 72 can be substantially circular. However, the passage 72 can also be oval, rectangular, and polygonal, just to name a few possibilities. The cross-section area of the passage 72 can be substantially constant, or it can vary along the length of the passage 72. In the case of multiple passages 72, the passages 72 can have substantially identical cross-sectional geometries and areas, but at least one of the passages 72 can be different in any of the above respects. Each passage 72 can be sized as needed.

According to aspects of the invention, at least a portion of air 78 can be routed from the rotor cooling air circuit 66 and delivered to the vane carrier 70. A supply conduit 80 can be connected in fluid communication with the second conduit segment 60 and, for example, the inlet end 74 of the passage 72 in the vane carrier 70. The supply conduit 80 can be connected to the vane carrier 70 and the rotor cooling air circuit 66 in various ways, such as by fasteners, couplings, seals, adhesives and/or threaded engagement. The supply conduit 80 can be connected to the rotor cooling air circuit 66 almost anywhere along the second conduit segment 60. Preferably, the supply conduit 80 connects to a portion of the second conduit segment 60 that is inside of the chamber 22. The supply conduit 80 can be routed as needed within the chamber 22 to avoid interferences with other components and to minimize disruptions in the flow of air within the chamber 22.

In some instances, a return conduit, such as a return conduit 82, can be extend between and can be connected in fluid communication with the second conduit segment 60 and the outlet end 76 of the passage 72 in the vane carrier 70. The return conduit 82 preferably connects to the second conduit segment 60 downstream (relative to the direction of the airflow in the second conduit segment 60) of where the supply conduit 80 connects to the second conduit segment 60. The return conduit 82 can be connected to the second conduit segment 60 and the outlet end 76 of the passage 72 in the vane carrier 70 in various ways, such as by fasteners, couplings, seals, adhesives and/or threaded engagement. The return conduit 82 can be routed as necessary to avoid interferences with other components and to minimize disruptions in the flow of air within the chamber 22.

The supply and return conduits 80, 82 can be sized as needed. The pipes 80, 82 can have any cross-sectional area such as circular, rectangular, triangular or polygonal. The cross-sectional area of each of the pipes 80, 82 can be substantially constant or it can vary. The pipes 80, 82 can be substantially straight, or they can include any number of bends, turns, curves, etc. The supply and return conduits can be defined by a single pipes 80, 82, or they can be defined by a plurality of pipe segments (not shown).

While FIG. 2 shows the inlet end 74 of the passage 72 located near the axial downstream end 84 of the vane carrier 70 and the outlet end 76 of the passage 72 located near the axial upstream end 86 of the vane carrier 70, it will be understood that aspects of the invention are not limited to this arrangement. For example, it will be readily appreciated that the opposite arrangement can be provided, that is, the inlet end 74 of the passage 72 can be provided near the axial upstream end 86 of the vane carrier 70, and the outlet end 76 of the passage 72 can be provided near the axial downstream end 84 of the vane carrier 70.

Just as there can be any number of passages 72 in the vane carrier 70, there can any number of supply and return conduits 80, 82. It should be noted that the number of supply conduits 80 may or may not be equal to the number of return conduits 82. Moreover, any number of supply and return conduits 80, 82 can be in fluid communication with any number of passages 72 in the vane carrier 70. In one embodiment, each passage 72 in the vane carrier 70 can have a dedicated supply conduit 80 and/or a dedicated return conduit 82. Alternatively, one supply conduit 80 can be in fluid communication with more than one passage 72 in the vane carrier 70. For instance, the supply conduit 80 can include a plurality of branches (not shown) with each branch in fluid communication with the inlet end 74 of a respective passage 72. In another embodiment, the supply conduit 80 can be in fluid communication with a plurality of passages 72 by way of a supply plenum (not shown) in the vane carrier 70. The supply plenum can be in fluid communication with a plurality of passages 72.

Similar arrangements can be provided between the return conduit 82 and the outlet end 76 of the passage 72. For instance, the vane carrier 70 can include a return plenum (not shown) that allows fluid communication between the return conduit 82 and a plurality of passages 72. There can be any number of supply and/or return plenums. The plenums can extend substantially circumferentially through at least a portion of the vane carrier 70. The plenums can have various cross-sectional geometries and surface contours, such as those discussed above in the context of the passages 72.

As noted earlier, greater control of the blade tip clearances can be achieved by selectively supplying and restricting air 78 to the vane carrier 70 or other stationary support structure. To that end, a system according to aspects of the invention can further include a flow regulator, such as a valve 88. The valve 88 can be disposed anywhere along the supply conduit 80 and/or the second conduit segment 60 of the rotor cooling air circuit 66. The valve 88 can be used to selectively permit and prohibit the flow of the air 78 from the rotor cooling air circuit 66 to the passage 72 in the vane carrier 70. The valve 88 can be operated manually or by a controller (not shown) operatively associated with the valve 88. The valve 88 can be any suitable valve.

Having described several of the individual components of a system according to aspects of the invention, one manner of using the blade tip clearance control system 68 will now be described. The method described herein is merely an example. Not every step described need occur, and the steps described are not limited to performance in the sequence described. For purposes of this example, it will be assumed that the operation begins from a cold start condition.

The turbine engine 10 can be operated as is known. From startup, the valve 88 can be closed so as to substantially restrict the air 58 in the second conduit segment 60 from entering the passage 72 in the vane carrier 70 and/or the supply conduit 80. The valve 88 can remain closed until a desired first operational parameter is reached. The operational parameter can be, for example, substantially steady state operation including base load operation. The first operational parameter can be any condition where most of the components that can affect the blade tip clearance C (blades 36, rotor 18, discs 38, outer casing 32, vane carrier 70, etc.) have thermally grown to their final shapes. In any of the above examples, the occurrence of the first operational parameter can be determined in various ways, such as by measuring engine power output. In one embodiment, the first operational parameter can occur when the engine is operating at about 90 percent power or greater. Alternatively, the first operational parameter can be a certain blade tip clearance C. To that end, blade tip clearances C can be measured during engine operation using sensors or probes, as is known. In still another embodiment, the first operational parameter can be the temperature of the stationary support structure, as measured by a thermal sensor or other temperature measurement device.

Once the desired operational parameter is reached, the valve 88 can be opened to allow at least a portion of the air 78 in the rotor cooling circuit 66 to be diverted therefrom. The air 78 can be directed to the vane carrier 70 by the supply conduit 80. The temperature of the air 78 supplied to the vane carrier 70 will be less than the operational temperature of the vane carrier 70. The air 78 can enter and travel through the passage 72 in heat exchanging relation with the vane carrier 70. Consequently, the temperature of the vane carrier 70 will decrease, and the temperature of the air 78 will increase. The vane carrier 70 will thermally contract at least in the radial direction. This contraction causes the vane carrier 70 to move closer to the blade tips 40, thereby reducing the blade tip clearance C. Thus, fluid leakage through the clearance C can be minimized and engine power and efficiency can be increased.

After passing in heat exchanging relation with the vane carrier 70, the air 90 can be directed to various areas. In one embodiment, the air 90 can be routed back to the rotor cooling air circuit 66 by the return conduit 82. The returned air 90 can mix with the cooled air 58 in the second conduit segment 60. It will be appreciated that the temperature of the returning air 90 will be greater than the temperature of the air 58 in the second conduit segment 60. As a result, the temperature of the air mixture in the rotor cooling air circuit 66 can be greater than the temperature of the air exiting the cooler 60, which can have an impact on the intended downstream cooling uses.

Such temperature changes can be monitored with a temperature measurement device operatively positioned along the pipe 66 downstream of the point at which the return conduit 82 connects to the second conduit segment 56. The temperature measurement device can be, for example, a thermocouple 92. The temperature measurement device can be operatively connected to the cooler by way of a controller (not shown), which can alert an operator when the temperature of the rotor cooling air increases beyond a predetermined temperature. The controller can be, for example, a computer. Any undesired increases in the temperature of the rotor cooling air 58 can be corrected by changing the operating parameters of the cooler 56 so as to lower the temperature of the air exiting the cooler 56.

While air 78 is being passed in heat exchanging relation with the vane carrier 70, the blade tip clearance C can be monitored to prevent blade tip rubbing from occurring. The blade tip clearance C can be measured in any of the various manners known in the art, such as probe measurement. The blade tip clearance C can be actively adjusted, as needed, by selectively increasing and decreasing the amount of air 78 delivered to the vane carrier 70, such as by way of the valve 88. Thus, a target blade tip clearance can be maintained. The target blade tip clearance can be, for example, a minimum clearance, a preferred clearance or range of clearance.

The supply of air 78 to the vane carrier 70 can continue for so long as needed or is desired or when a second operational parameter is reached. In such case, air flow to the supply conduit 80 and/or to the passage 72 can be substantially restricted, such as by closing the valve 88. The second operational parameter can be, for example, a minimum design blade tip clearance C. Alternatively, the second operational parameter can be part load operation, as measured by engine power output. In one embodiment, the second operational parameter can occur when the engine is operating at less than about 90 percent power. The second operational parameter can also be the temperature of the stationary support structure, as measured by a thermal sensor or other temperature measurement device.

While especially suited for minimizing the tip clearance in the first row of turbine blades in a turbine section of a turbine engine, aspects of the invention can be applied to any and all rows of blades in the turbine section. Further, as noted above, aspects of the invention can be particularly beneficial during steady state engine operation, such as at base load. However, aspects of the invention can be used during part load operation as well or any condition in which improved engine performance is desired. Thus, it will of course be understood that the invention is not limited to the specific details described herein, which are given by way of example only, and that various modifications and alterations are possible within the scope of the invention as defined in the following claims.

What is claimed is:

1. A blade tip clearance control system comprising a turbine engine having a compressor section, a combustor section having a chamber receiving compressed air from the compressor section, and a turbine section, wherein the turbine section includes a plurality of discs mounted to a rotor, wherein a plurality of blades are attached to the discs, each blade extending radially outward from the respective disc to a tip;

a stationary support structure substantially surrounding at least a portion of the blades, wherein a clearance is defined between the tips of the blades and the stationary support structure, the stationary support structure being at a first temperature;

a rotor cooling air circuit including a fluid conduit and a cooler disposed along the fluid conduit, the fluid conduit being connected in fluid communication with the chamber of the combustor section such that a portion of the compressed air in the chamber is received within the fluid conduit, wherein the portion of compressed air passes in heat exchanging relation with the cooler such that the temperature of the portion of air is reduced to a second temperature, wherein the second temperature is less than the first temperature, wherein the cooler is external to the chamber of the combustor section, and wherein the fluid conduit downstream of the cooler is initially external to the chamber of the combustor section and then enters the chamber of the combustor section; and a supply conduit connected in fluid communication with the fluid conduit at a point within the chamber and extending therefrom, the supply conduit extending entirely within the chamber, wherein the supply conduit routes at least a portion of the air at the second temperature to the stationary support structure so that the air passes in heat exchanging relation with the stationary support structure, whereby the stationary support structure contracts to reduce the clearance.

2. The system of claim 1 wherein the stationary support structure is at least one of a vane carrier, a ring seal and an outer casing.

3. The system of claim 1 wherein at least one passage extends through at least a portion of the stationary support structure, the passage having an inlet and an outlet, wherein the supply conduit is connected in fluid communication with the inlet of the passage such that the passage receives the air at the second temperature.

4. The system of claim 1 further including a return conduit positioned to receive the air that has passed in heat exchanging relation with the stationary support structure, wherein the return conduit is connected in fluid communication with the fluid conduit downstream of the area where the supply conduit connects to the fluid conduit, whereby air that has passed in heat exchanging relation with the stationary support structure is routed back to the fluid conduit.

5. The system of claim 4 further including a temperature measurement device operatively associated with the fluid conduit downstream of the area where the return conduit connects to the fluid conduit.

6. The system of claim 1 further including a valve operatively positioned along one of the fluid conduit and the supply conduit to selectively permit and prohibit the supply of air at the second temperature to the stationary support structure.

7. The turbine system of claim 6 wherein, at base load engine operation, the valve permits the supply air at the second temperature to the stationary support structure.

8. A blade tip clearance control system comprising a turbine engine having a compressor section, a combustor section having a chamber receiving compressed air from the compressor section, and a turbine section, wherein the turbine section including a plurality of discs mounted to a rotor, wherein a plurality of blades are attached to the discs, each blade extending radially outward from a respective one of the discs to a tip;

a stationary support structure substantially surrounding at least a portion of the blades, wherein a clearance is defined between the tips of the blades and the stationary support structure, the stationary support structure having at least one passage extending therethrough, the passage having an inlet end and an outlet end, the stationary support structure being at a first temperature;

a rotor cooling air circuit including a fluid conduit and a cooler disposed along the fluid conduit, the fluid conduit connected in fluid communication with the chamber of the combustor section such that a portion of the compressed air in the chamber is received within the fluid conduit, wherein the portion of compressed air passes in heat exchanging relation with the cooler such that the temperature of the portion of air is reduced to a second temperature, wherein the second temperature is less than the first temperature;

a supply conduit connecting between and in fluid communication with the fluid conduit and the inlet end of the passage, wherein the supply conduit routes at least a portion of the air at the second temperature to the passage, wherein the air passes through the passage in heat exchanging relation with the stationary support structure, whereby the stationary support structure contracts to reduce the clearance;

a return conduit connecting between and in fluid communication with the outlet end of the passage and the fluid conduit, wherein the return conduit connects to the fluid conduit downstream of the area where the supply conduit connects to the fluid conduit, whereby air exiting the passage is routed back to the rotor cooling air circuit; and a valve operatively positioned along one of the fluid conduit and the supply conduit to selectively permit and prohibit the supply of air at the second temperature to the stationary support structure.

9. The system of claim 8 further including a temperature measurement device operatively associated with the fluid conduit downstream of the area where the return conduit connects to the fluid conduit, wherein the temperature measurement device is operatively connected to the cooler, whereby the temperature of the coolant exiting the cooler can be altered as necessary.

10. The system of claim 8 wherein the stationary support structure is one of a vane carrier, a ring seal and an outer casing.

* * * * *